US006244070B1

(12) United States Patent
Lee et al.

(10) Patent No.: US 6,244,070 B1
(45) Date of Patent: Jun. 12, 2001

(54) LEAN REFLUX PROCESS FOR HIGH RECOVERY OF ETHANE AND HEAVIER COMPONENTS

(75) Inventors: Rong-Jwyn Lee; Jame Yao; Jong Juh Chen, all of Sugar Land; Douglas G. Elliot, Houston, all of TX (US)

(73) Assignee: IPSI, L.L.C., Houston, TX (US)

( * ) Notice: Subject to any disclaimer, the term of this patent is extended or adjusted under 35 U.S.C. 154(b) by 0 days.

(21) Appl. No.: 09/454,272

(22) Filed: Dec. 3, 1999

(51) Int. Cl.[7] ..... F25J 3/00
(52) U.S. Cl. ..... 62/620; 62/621
(58) Field of Search ..... 62/620, 621, 618, 62/630, 623

(56) References Cited

U.S. PATENT DOCUMENTS

| | | | | |
|---|---|---|---|---|
| 4,140,504 | | 2/1979 | Campbell et al. | 62/28 |
| 4,157,904 | | 6/1979 | Campbell et al. | 62/27 |
| 4,251,249 | | 2/1981 | Gulsby | 62/28 |
| 4,278,457 | | 7/1981 | Campbell et al. | 62/24 |
| 4,453,958 | | 6/1984 | Gulsby et al. | 62/28 |
| 4,456,461 | * | 6/1984 | Perez | 62/630 |
| 4,496,380 | * | 1/1985 | Harryman | 62/630 |
| 4,519,824 | | 5/1985 | Huebel | 62/26 |
| 4,617,039 | | 10/1986 | Buck | 62/26 |
| 4,629,484 | * | 12/1986 | Kister | 62/630 |
| 4,687,499 | | 8/1987 | Aghili | 62/24 |
| 4,695,303 | | 9/1987 | Montgomery, IV et al. | 62/24 |
| 4,698,081 | | 10/1987 | Aghili | 62/24 |
| 4,752,312 | | 6/1988 | Prible | 62/25 |
| 4,851,020 | | 7/1989 | Montgomery, IV et al. | 62/24 |
| 4,854,955 | | 8/1989 | Campbell et al. | 62/24 |
| 4,869,740 | | 9/1989 | Campbell et al. | 62/24 |
| 4,889,545 | | 12/1989 | Campbell et al. | 62/24 |
| 5,275,005 | | 1/1994 | Campbell et al. | 62/24 |
| 5,325,673 | | 7/1994 | Durr et al. | 62/23 |
| 5,566,554 | | 10/1996 | Vijayaraghavan et al. | 62/621 |
| 5,685,170 | | 11/1997 | Sorensen | 62/625 |
| 5,890,377 | | 4/1999 | Foglietta | 62/621 |
| 5,890,378 | | 4/1999 | Rambo et al. | 62/621 |
| 5,953,935 | * | 9/1999 | Sorensen | 62/621 |

* cited by examiner

*Primary Examiner*—William Doerrler
(74) *Attorney, Agent, or Firm*—Madan, Mossman & Sriram, P.C.

(57) ABSTRACT

A simple, efficient, and cost effective process for separating components of a feed gas, e.g., containing methane and heavier hydrocarbons has been devised. First, feed gas is condensed to provide a vapor component and a liquid component. The vapor component is divided into at least a first, major portion a second portion, and a remaining portion. The second portion is directed to a lean reflux absorber, and the remaining portion is condensed and fed to the top of the lean reflux absorber. A bottom fluid stream, generally a liquid intermediate product, is recovered from the bottom of the lean reflux absorber, and lean vapor is recovered from the top of the lean reflux absorber. The liquid component, the first, major portion of the first vapor component, the liquid product from the bottom of the lean reflux absorber, and the lean vapor from the top of the lean reflux absorber are all fed to different feed points on a cryogenic distillation column. An optional cold side reboiler may be used to bring the cooling and heating curves into a more parallel relationship to improve process efficiency.

34 Claims, 9 Drawing Sheets

(Comparative)

LEAN REFLUX PROCESS FOR HIGH RECOVERY OF ETHANE AND HEAVIER COMPONENTS

FIELD OF THE INVENTION

The present invention relates to systems and methods for recovering ethane, ethylene and heavier hydrocarbons from natural gases and other gases, e.g. refinery gases, and in a further embodiment relates to methods and structures for recovering ethane, ethylene and heavier hydrocarbon components in excess of 90% from natural gases and other gases using a cryogenic separation process.

BACKGROUND OF THE INVENTION

Cryogenic expansion processes have been well recognized and employed on a large scale for hydrocarbon liquids recovery since the turbo-expander was first introduced to gas processing in the 1960s. It has become the preferred process for high ethane recovery with or without the aid of an external refrigeration depending upon the richness of the gas. In a conventional turbo-expander process, the feed gas at elevated pressure is pre-cooled and partially condensed by heat exchange with other process streams and/or external propane refrigeration. The condensed liquid with less volatile components is then separated and fed to a fractionation column (demethanizer), operated at medium or low pressure, to recover the heavy hydrocarbon constituents desired. The remaining non-condensed vapor portion is subjected to turbo-expansion to a lower pressure, resulting in further cooling and additional liquid condensation. With the expander discharge pressure typically the same as the demethanizer pressure, the resultant two-phase stream is fed to the top section of the demethanizer with the cold liquids acting as the top reflux to enhance recovery of heavier hydrocarbon components. The remaining vapor combines with the column overhead as a residue gas which is then recompressed to pipeline pressure after being heated to recover available refrigeration.

Because the demethanizer operated as described above acts mainly as a stripping column, the expander discharge vapor leaving the column overhead that is not subject to rectification still contains a significant amount of heavy components. These components could be further recovered if they were brought to a lower temperature, or subject to a rectification step. The lower temperature option could be achieved by a higher expansion ratio and/ or a lower column pressure, but the compression horsepower would have to be too high to be economical. Ongoing efforts attempting to achieve a higher liquid recovery have mostly concentrated on the addition of a rectification section and how to effectively increase or provide a colder and leaner reflux stream to the expanded vapor. Many patents exist pertaining to a better and improved design for separating ethane and heavier components from a hydrocarbon-containing feed gas stream.

U.S. Pat. No. 4,140,504 describes methods to improve liquid recovery in a typical cryogenic expansion process by adding a rectification section to the expander discharge vapor, and using the partially condensed liquid as the reflux after it is further cooled and expanded to the top of the rectification section. U.S. Pat. No. 4,251,249 adds a separator at expander discharge, separates liquid from the expanded two phase stream, and sends the liquid to column for further processing. The separated vapor provides refrigeration in a reflux condenser to minimize the loss of heavy components in the overhead vapor stream. In yet another approach, e.g. U.S. Pat. No. 5,566,554, the partially condensed liquid is preheated and expanded to a second separator at an intermediate pressure to yield a vapor stream preferably comprising lighter hydrocarbon components. This leaner stream returns to the demethanizer top as an enhanced reflux after being condensed again and subcooled. The reflux stream so generated is rather limited, and the heavy components not recovered are still substantial.

The most recognized approach for high ethane recovery, perhaps, is the split-vapor process as disclosed in U.S. Patent Nos. 4,157,904 and 4,278,457. In these patents, the non-condensed vapor is split into two portions with the majority one, typically about 65%–70%, passing through a turbo-expander as usual, while the remaining portion being substantially subcooled and introduced to the demethanizer near the top. This higher and colder reflux flow permits an improved ethane recovery at a higher column pressure, thereby reducing recompression horsepower requirements, in spite of less flow being expanded via the turbo-expander. It also provides an advantage in reducing the risk of $CO_2$ freezing in the demethanizer. The achievable recovery level in these processes, however, is ultimately limited by the composition of the vapor stream used for the top reflux due to equilibrium constraints. Ethane recovery is said to be on the order of 90%, with propane recovery to be about 98%.

The use of a leaner reflux is an attempt to overcome the aforementioned deficiency. One approach is to cool the split vapor stream half way through and expand it to an intermediate pressure, causing partial condensation. The condensed liquid comprising less volatile components is separated in a separator and fed to the demethanizer above the feed from the turbo-expander discharge as the mid-reflux. The leaner vapor so generated is further cooled to substantial condensation and used as top reflux. U.S. Pat. No. 4,519,824 is a typical example. U.S. Patent 5,555,748 further improves this process by cooling the separated liquid prior to entering demethanizer as the mid-reflux. However, the internal pinch expected in the reflux exchanger precludes the capability of generating a higher top reflux flow because it is leaner and at a lower pressure leading to a lower condensation temperature. In addition, the top reflux generated from a single stage separation in the separator utilized is still far from essentially ethane-free.

U.S. Pat. No. 5,953,935 discloses a method to further condition the cooled split vapor by employing a scrub column to produce reflux streams for the demethanizer. The scrub column uses overhead vapor condensate as its reflux stream to produce a bottom liquid stream preferentially containing ethane and less volatile constituents from the two feed streams, the vapor feed at the bottom and the partially condensed feed in the middle. The bottom liquid and a portion of overhead vapor condensate are then flashed to the demethanizer as the reflux to enhance ethane recovery. With the column normally operating at an intermediate pressure, an internal pinch in the reflux condenser, similar to U.S. Pat. No. 4,519,824, often exists and precludes the capability of generating a higher top reflux flow from this scheme. The top reflux flow available for the demethanizer becomes even less when a portion of already limited condensate is required for the scrub column by itself. Although a leaner reflux can be generated for the demethanizer, its advantage is largely off-set by the reduction in its flow rate. In addition, cryogenic pumps and often a reflux drum are also required to facilitate the reflux scheme for the scrub column.

A substantially ethane-free reflux has been introduced in some processes which permits essentially total recovery of ethane and heavier components from a hydrocarbon containing feed stream. These processes recycle a portion of the residue gas stream as the top reflux after being condensed and deeply sub cooled. Because the residue gas contains the least amount of ethane in the entire process, ethane recovery in excess of 98% is economically achievable by providing more and leaner reflux from recycle of a significant amount of residue gas. It should be noted that it is the liquid reflux in contact with, providing refrigeration to, and promoting condensation of the uprising heavy components vapor to enhance liquid recovery. Therefore, the recycle of residue gas must be recompressed to a much higher pressure with penalty on compression horsepower to enable its total condensation.

U.S. Pat. Nos. 4,851,020 and 4,889,545 utilize the cold residue gas from the demethanizer overhead as the recycle stream. This process requires a compressor operating at a cryogenic temperature. Warm residue gas taken from the residue gas compressor, eliminating the need of a dedicated compressor, is disclosed in U.S. Pat. Nos. 4,687,499 and 5,568,737. However, an alternate arrangement with a recycle compressor which is required for a low residue gas pressure scenario and/or permits optimal pressure of recycle residue gas for minor improvement in separation efficiency is also presented in U.S. Pat. No. 5,568,737. Although high liquid recovery is attainable, the system requires increases in capital cost and incurs higher operating costs due to penalty on compression horsepower.

It is desirable for a process to be provided which maximizes ethane recovery but does not require undesirable increases in capital and operating costs.

SUMMARY OF THE INVENTION

Accordingly, it is an object of the present invention to provide a process for separating components of a feed gas containing methane and heavier hydrocarbons which maximizes ethane recovery but does not require appreciable increases in capital and operating costs.

In carrying out these and other objects of the invention, there is provided, in the broadest sense, a process for cryogenically recovering components of hydrocarbon-containing feed gas in a distillation column, e.g. a cryogenic distillation column such as a demethanizer, in which its top reflux is generated by a lean reflux absorber, where the top reflux is essentially free of components recovered. The process involves introducing a substantially condensed feed to the top, and at least another cooled gas/partially condensed feed to the bottom of the separate lean reflux absorber. From the lean reflux absorber, which comprises one or more mass transfer stages, a lean vapor containing very little of components to be recovered, e.g. ethane and heavier, is generated from the top of the absorber. A liquid stream is withdrawn from the bottom of the absorber. The lean vapor is further cooled to form a predominant liquid stream and is thereafter introduced to the top of the cryogenic distillation column (e.g. demethanizer) as reflux. The liquid stream, in a more preferred embodiment, is also cooled prior to introducing it to the middle of the rectification section of demethanizer as the middle reflux.

In another form of the methods of present invention, the top and bottom feeds to the lean reflux absorber are both derived from said feed gas, first involving condensing said feed gas to provide a first vapor component and a first liquid component. The first vapor component is divided into at least a main vapor portion, a bottom feed portion, and a top feed portion. The bottom and top feed portions are cooled or condensed accordingly to form the feeds to the lean reflux absorber. The main vapor portion and the first liquid component are expanded and supplied to different feed points below the rectification section of the cryogenic distillation column (e.g. demethanizer). The recovery efficiency is substantially enhanced as the expanded streams are subjected to rectification using the reflux components generated from the lean reflux absorber.

In another embodiment of the present invention, the top feed to the lean reflux absorber is derived from the volatile residue gas, and similarly the bottom feed is obtained from the feed gas as previously described. After being compressed, at least a small portion of residue gas is drawn off and cooled to substantial condensation for the top feed to the absorber. The use of residue gas containing the least amount of component recovered in this manner enhances the separation efficiency within the lean reflux absorber, leading to a leaner vapor stream generated from the absorber. Consequently, the recovery efficiency within the cryogenic distillation column (e.g. demethanizer) is improved, which results from the provision of a leaner reflux for rectification.

The recovery efficiency can be further improved in yet another form of the present invention, in which a small expander/compressor is provided in association with lean reflux absorption. In this embodiment, the bottom feed portion is expanded directly through a work expansion turbine in which additional work is recovered and results in further cooling to the expanded stream. The recovered work, in one preferred form, can be utilized to compress the lean vapor from the absorber. This configuration permits the absorber to be operated at a more favorable (lower) pressure, a leaner vapor stream to be generated therein, and consequently improves recovery efficiency even further.

BRIEF DESCRIPTION OF THE DRAWINGS

The application and advantages of the invention will become more apparent by referring to the following detailed description in connection with the accompanying drawings, wherein.

It will be appreciated that FIGS. 1–2 and 6–9 are not to scale or proportion as they are simply schematics for illustration purposes.

DETAILED DESCRIPTION OF THE INVENTION

For purposes of comparison only, an exemplary prior process will be described with reference to FIG. 1 and compared with the inventive process. The methods of the present invention will be described with reference to FIGS. 2, 6, 7, 8, and 9. Various values of temperature and pressure are recited in association with specific examples; those conditions are approximate and merely illustrative, and are not meant to limit the invention. In one non-limiting embodiment of the invention, where ethane and heavier components are desired to be recovered from a feed gas, at least about 90% of the C2+ hydrocarbons in said feed gas are recovered in said natural gas liquid product; preferably at least about 95%.

Additionally, for purposes of this invention, when the term "predominantly" is used to describe e.g. that a stream contains "predominantly" volatile vapor components, it is meant that greater than 50% of the stream is the recited component. Further, with respect to the terms "upper" and "lower" as used with respect to a column or absorber, these terms are to be understood as relative to each other, i.e. that withdrawal of a stream from an "upper" region of a absorber is at a higher position than a stream withdrawn from a "lower" region thereof. In one non-limiting embodiment, "upper" may refer to the upper half of a column or absorber, whereas "lower" may refer to the lower half of a column or absorber. In another embodiment, where the term "middle" is used, it is to be understood that a "middle" region is intermediate to an "upper" region and a "lower" region. However, where "upper", "middle", and "lower" are used to refer to a demethanizer or cryogenic distillation column, it should not be understood that such column is strictly divided into thirds by these terms.

Figure 1:
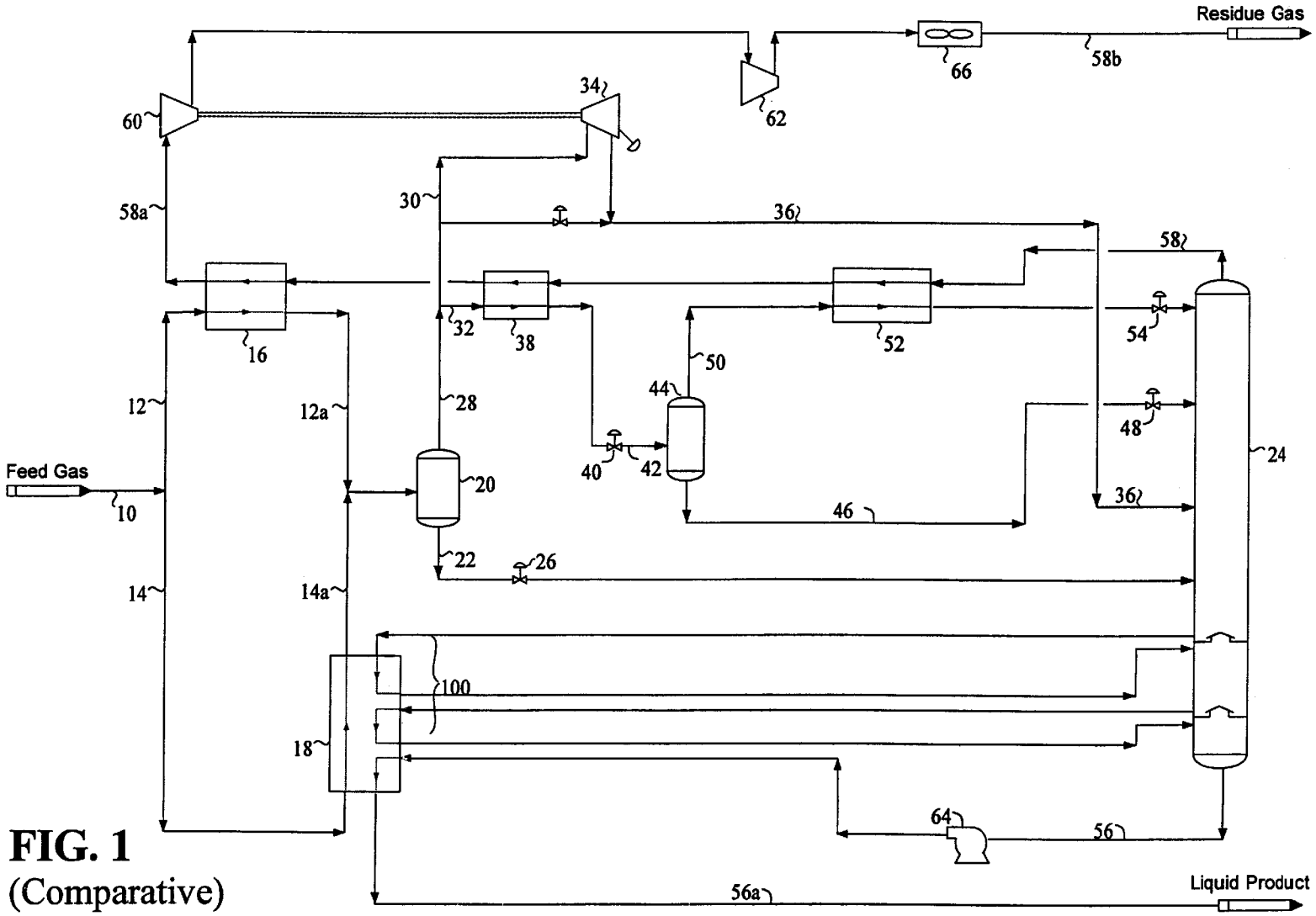
FIG. 1 is a schematic representation of a comparative cryogenic expansion process.

Shown in FIG. 1 is a process similar to that disclosed in U.S. Pat. No. 4,519,824, in which dry feed gas enters the cryogenic process at 990 psia and 120° F., e.g., as stream 10. This dry feed gas has been pretreated as necessary to remove any concentration of sulfur compounds, mercury, and water. Feed stream 10 is first cooled to −64° F. via a typical heating/cooling arrangement by splitting stream 10 into streams 12 and 14 with stream 12 being cooled in gas/gas exchanger 16 and stream 14 being cooled in gas/liquid exchanger 18 prior to entering the expander inlet separator 20 for separation of condensed liquid, if any, as stream 22. The liquid portion as stream 22 is delivered to the middle of demethanizer 24 below the feed of expander discharge 36, after being flashed to the demethanizer pressure in expansion valve 26.

The vapor portion stream 28 from expander inlet separator 20 is divided into two streams: main portion 30 and remaining portion 32. The main portion 30, about 63%, is expanded through the expander 34 prior to entering the demethanizer 24 right below the overhead rectifying section as expander discharge 36. The remaining vapor portion 32 is pre-cooled to approximately −81° F. in the precooler 38 and expanded through expansion valve 40 to an intermediate pressure to produce a two phase stream 42. The liquid portion 46 separated in the medium pressure separator 44 is expanded at its saturated temperature in expansion valve 48 and fed to demethanizer 24 above the feed of expander discharge 36 as the mid-reflux. The remaining vapor in stream 50, with reduced ethane content, is condensed and subcooled in the reflux exchanger 52 and then flashed to the demethanizer 24 overhead through expansion valve 54.

The demethanizer operated at approximately 352 psia is a conventional distillation column containing a plurality of mass contacting devices, trays or packings, or some combinations of the above. It is typically equipped with one or more liquid draw trays in the lower section of the column to provide heat to the column for stripping volatile components off from the bottom liquid product. This is accomplished via the use of a bottom reboiler as well as a side reboiler 100.

Within the demethanizer, ethane and heavier components are recovered in bottom liquid product stream 56 while leaving methane and lighter compounds in the top overhead vapor as residue gas stream 58. The residue gas stream 58 after being heated to near feed gas temperature in reflux exchanger 52, precooler 38, and gas/gas exchanger 16 is recompressed to the delivery pressure of 650 psia via the expander-compressor 60 first, followed by the residue gas compressor 62. A residue gas compressor aftercooler 66 may be present for a final cooling operation. The bottom liquid product stream 56 is pumped via pump 64 and delivered after providing refrigeration to the gas/liquid exchanger 18.

The methods of the present inventions will now be illustrated with reference to FIGS. 2, 6, 7, 8, and 9.

Figure 2:
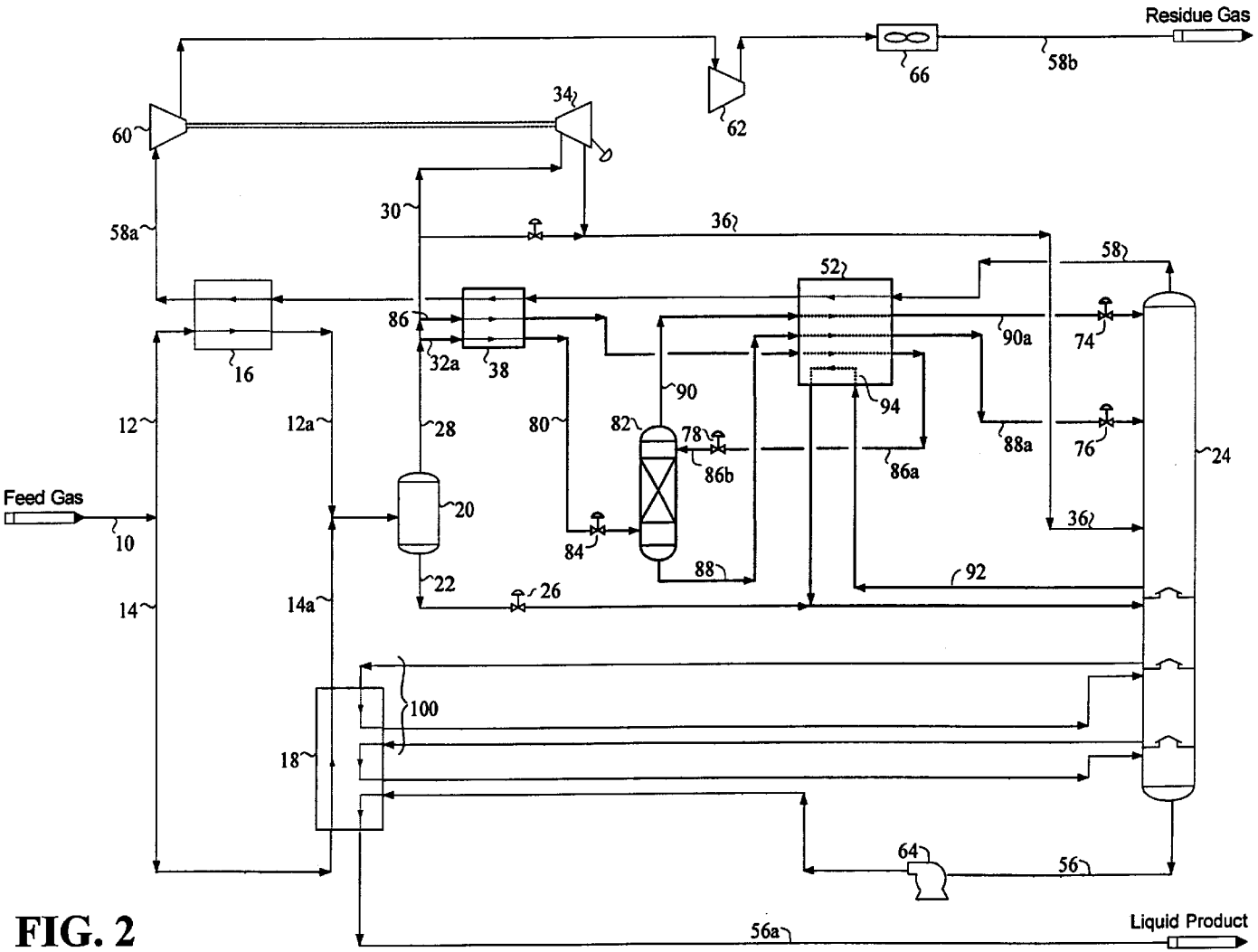
FIG. 2 is a schematic flow diagram of a cryogenic expansion process incorporating the improvements of the present invention.

Shown in FIG. 2 is one embodiment of the hydrocarbon gas processing system of the invention, where the same reference numerals as used previously refer to similar streams and equipment. In one non-limiting embodiment of the invention, dry feed gas 10 is first cooled to −52° F. via a heating/cooling arrangement similar to FIG. 1 prior to entering expander inlet separator 20 for the separation of condensed liquid, if any. The liquid portion 22 is delivered to the middle of demethanizer 24 below the feed of expander discharge 36 for further fractionation.

The vapor portion 28 is divided into three streams: the first main vapor portion 30, about 61%, e.g., is expanded through expander 34 with the resultant two-phase stream 36 entering the demethanizer 24 right below the overhead rectifying section. First, major vapor portion 30 would, in most embodiments, be greater than 50% of vapor portion stream 28. The second portion 32*a*, about 31% e.g., is pre-cooled to approximately −70° F. in the precooler (condenser) 38, and then fed as stream 80 to the bottom of the lean reflux absorber 82 after being flashed to an intermediate pressure of about 635 psia through expansion valve 84. The remaining vapor, the third stream 86, is condensed, subcooled (e.g. through precooler 38 and reflux exchanger 52) as stream 86*a* and enters the top of the lean reflux absorber 82 after expanding through expansion valve 78 as stream 86*b* to preferentially recover the desired heavy compounds at the bottom as a bottom fluid stream 88 (which in most cases will be a liquid intermediate product), resulting in a leaner vapor stream 90 from the lean reflux absorber 82 overhead. Both the bottom fluid stream 88 and the leaner vapor stream 90 are further cooled to substantial condensation as streams 88*a* and 90*a*, respectively, prior to being fed to the demethanizer 24 as middle and top reflux through expansion valves 76 and 74, respectively, to enhance liquid recovery.

Liquid collected in chimney tray near the feed of the expander discharge 36 may be optionally withdrawn as stream 92 and heated in the reflux exchanger 52 as a cold side reboiler 94 providing additional refrigeration for condensing the leaner vapor 90 from the lean reflux absorber 82.

Ethane and heavier components are recovered in the bottom liquid product 56 while leaving methane and lighter compounds in the top overhead vapor as residue gas 58. The residue gas 58 after being heated to near feed gas temperature is recompressed to the delivery pressure of 650 psia via the expander-compressor 60 first, followed by the residue gas compressor. The ethane liquid 56 is pumped via pump 64 and delivered after providing refrigeration to the gas/liquid exchanger 18.

Lean reflux absorber 82 may contain one or more mass transfer stages. The lean reflux absorber 82 may be or any suitable device for separating a bottom fluid stream 88 and a leaner vapor stream 90 therefrom. In one non-limiting embodiment, the lean reflux absorber 82 has only one absorption section with top reflux and bottom stripping feeds.

Table I presents the performances of the comparative processes and the inventive process discussed above.

TABLE I

Performance of Comparative and Inventive Processes

| Description | Comparative - FIG. 1 | Inventive - FIG. 2 |
|---|---|---|
| Demethanizer Pressure, psia | 352 | 384 |
| Liquid Recovery | | |
| Ethane Product, Bbl/Day | 20,649 | 20,652 |
| % Recovery - C2 | 95.03 | 95.05 |
| % Recovery - C3 | 99.79 | 99.80 |
| Compression, HP | 12,553 | 10,270 |
| Recovery Efficiency | | |
| HP-Hr/Bbl of C2 Liq. | 14.59 | 11.93 |
| % Dev. | 22.2% | 0.0% |
| Demethanizer Top Reflux | | |
| Flow, lb-mol/hr | 7,650 | 8,370 |
| Ethane Content, mol % | 3.13 | 2.29 |
| Demethanizer Mid Reflux Temp. ° F.* | −108 | −139 |

*Temperature prior to expansion valve.

As shown, the process according to FIG. 1 requires a total recompression horsepower of 12,553 HP to achieve a 95% ethane recovery. This is compared to 10,270 HP for the inventive FIG. 2 process herein. By comparing the separation efficiency based on unit horsepower consumption, i.e. HP-Hr required to produce one Bbl of ethane product, it is apparent that the new process improves separation efficiency by about 22% over the FIG. 1 case.

As mentioned earlier, the improvement in separation efficiency achieved by the new, inventive process can be attributed to its provision of the reflux stream including, but not necessarily limited to, the following enhancements:

Higher Flow

Figure 3:
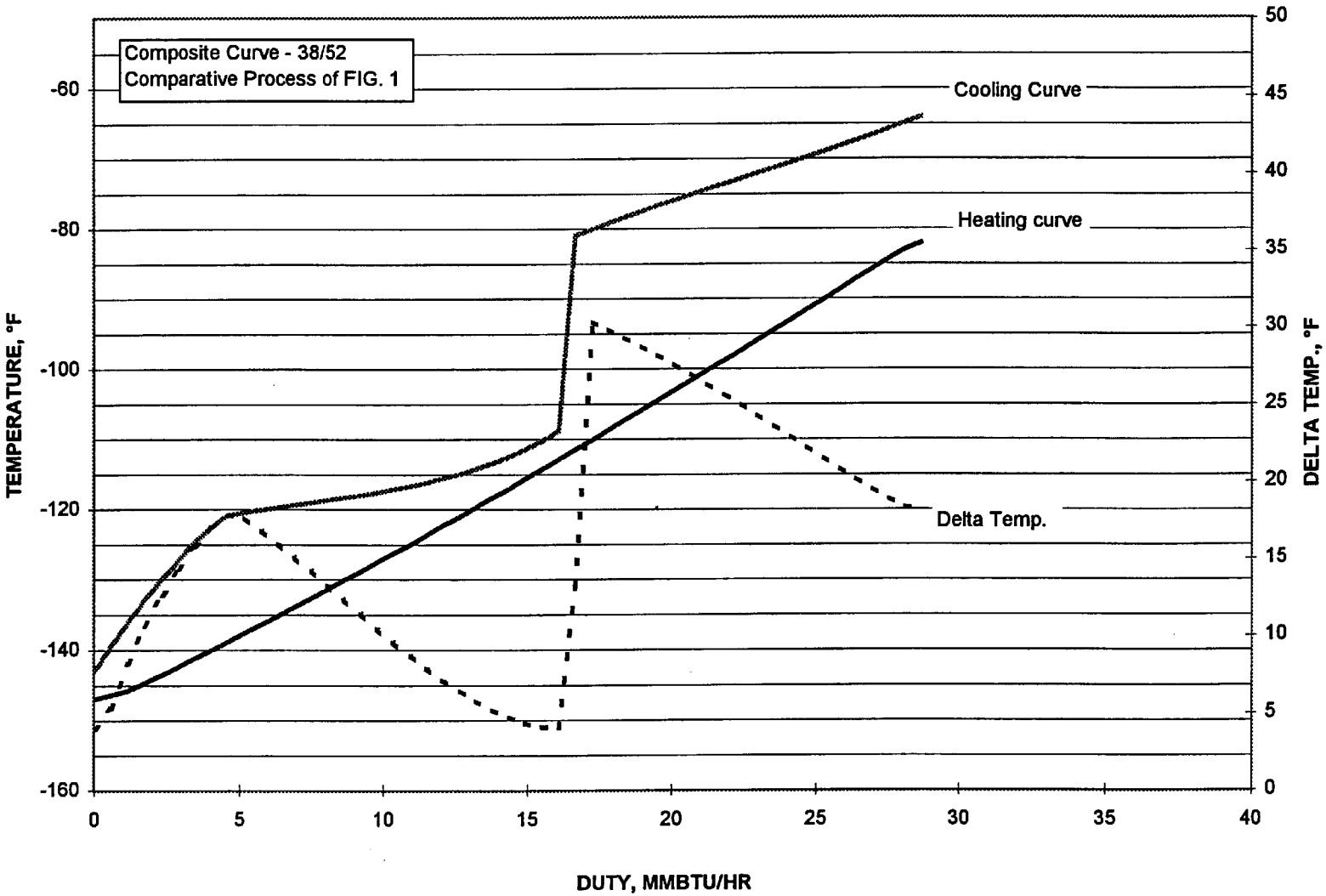
FIG. 3 is a graph of plots of the cooling curve, heating curve and temperature difference curve for the FIG. 1 comparative process.

As noted earlier, the inability to produce a higher top reflux flow for the demethanizer is one deficiency in the prior art where the split vapor stream is preconditioned to produce a leaner reflux by means of a separator in FIG. 1 process, or a scrub column in U.S. Pat. No. 5,953,935. In general, the lower the separator or scrub column pressure, the better the separation efficiency, thereby producing a leaner vapor. This leaner vapor generated at a lower pressure, however, will be condensed at a lower temperature, which requires much colder refrigeration. An internal pinch therefore occurs in the reflux exchanger which limits the leaner vapor flow to be condensed when the cold residue gas typically available with the sensible energy is used as refrigeration. This condensing flow can be somewhat increased at a warmer temperature by raising its pressure. Unfortunately, it makes the pre-conditioning more difficult or even unstable when its operation pressure is increased, particularly for a fractionation column, as it becomes closer to the critical point. By examining the composite curve for the precooler and reflux exchanger as depicted in FIG. 3, it is revealed that a temperature pinch exists internally for the comparative FIG. 1 process and a much wider temperature approach elsewhere. This wider temperature approach, in particular at the very cold temperature ranges, represents the process inefficiency.

Figure 4:
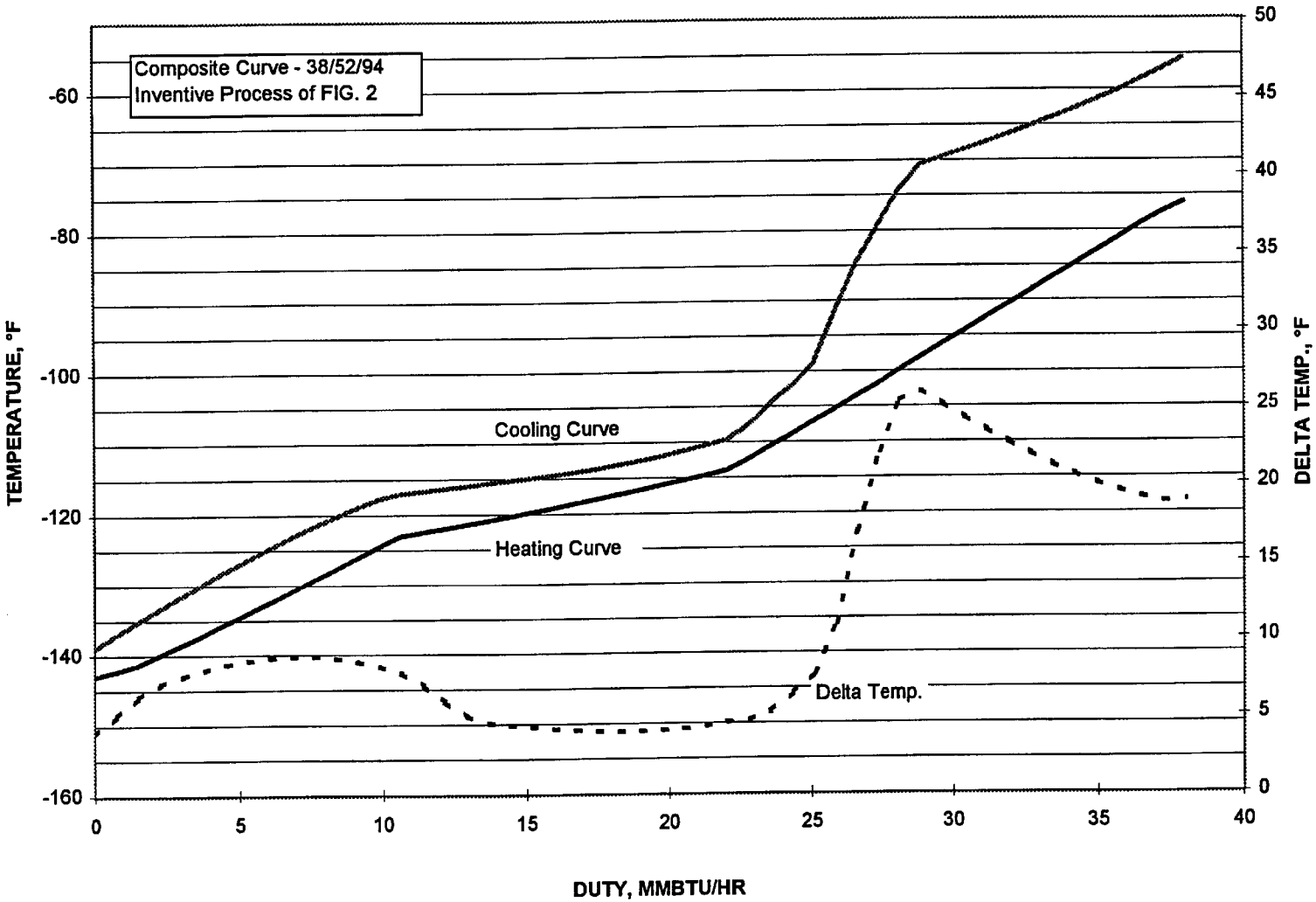
FIG. 4 is a graph of plots of the cooling curve, heating curve and temperature difference curve for the FIG. 2 inventive process.

The deficiency is corrected by the provision of a lean reflux absorber 82 and integration of a cold side reboiler 94 proposed here. The absorber uses cold feed gas, which can be substantially condensed and subcooled at a warmer temperature near the feed gas pressure, as the reflux. The inventive lean reflux absorber 82 eliminates the need for reflux pumps and drum, and also reduces the tendency of internal pinch. In addition, a cold liquid selectively withdrawn from the upper portion of the cryogenic distillation column 24 provides optimal refrigeration level for condensing lean vapor generated from the lean reflux absorber 82. As shown in FIG. 4 for the inventive FIG. 2 process, the cooling and heating curves run almost in parallel with a much narrower temperature approach over the coldest section of the process, reflecting a much more efficient process. In addition, the additional refrigeration provided by the cold liquid withdrawn near the expander feed tray (cold side reboiler 94) permits the generation of a higher reflux flow, 10% higher than the comparative FIG. 1 case, before a temperature pinch occurs in the exchanger. In addition to the improved overall energy integration, this invention permits the lean reflux absorber 82 to be operated at a lower pressure, further away from its critical point, facilitating its satisfactory operation.

Colder Reflux

It is also shown that the higher exchanger duty in precooler 38 and reflux exchanger 52 permits both the overhead vapor 90 and bottom fluid stream 88 being substantially subcooled before fed to the column 24 in the inventive scheme. For instance, the bottom fluid stream which is mid reflux 88*a* proposed in the inventive FIG. 2 process can be subcooled to −139° F. as compared to the saturated temperature of −108° F. used in the comparative FIG. 1 case. This deeply subcooled liquid yields less flashing upon pressure reduction, additional condensation of heavy compounds in the up-flowing vapor from the expander discharge 36, and enhancement in overall liquid recovery.

Leaner Reflux

As indicated, a leaner reflux can be obtained by the employment of an lean reflux absorber 82, even at a higher flow as compared to the comparative FIG. 1 case. This leaner top reflux generated in the inventive process permits the column to be operated at a higher pressure, thereby reducing the recompression horsepower. Its generation, however, resulting from an improvement in overall energy integration does not incur additional recompression horsepower as in the prior art processes of recycling residue gas.

While there is a trade-off between increasing reflux vs. making the reflux colder, it is possible to perform either one or the other while simultaneously using leaner reflux.

Figure 5:
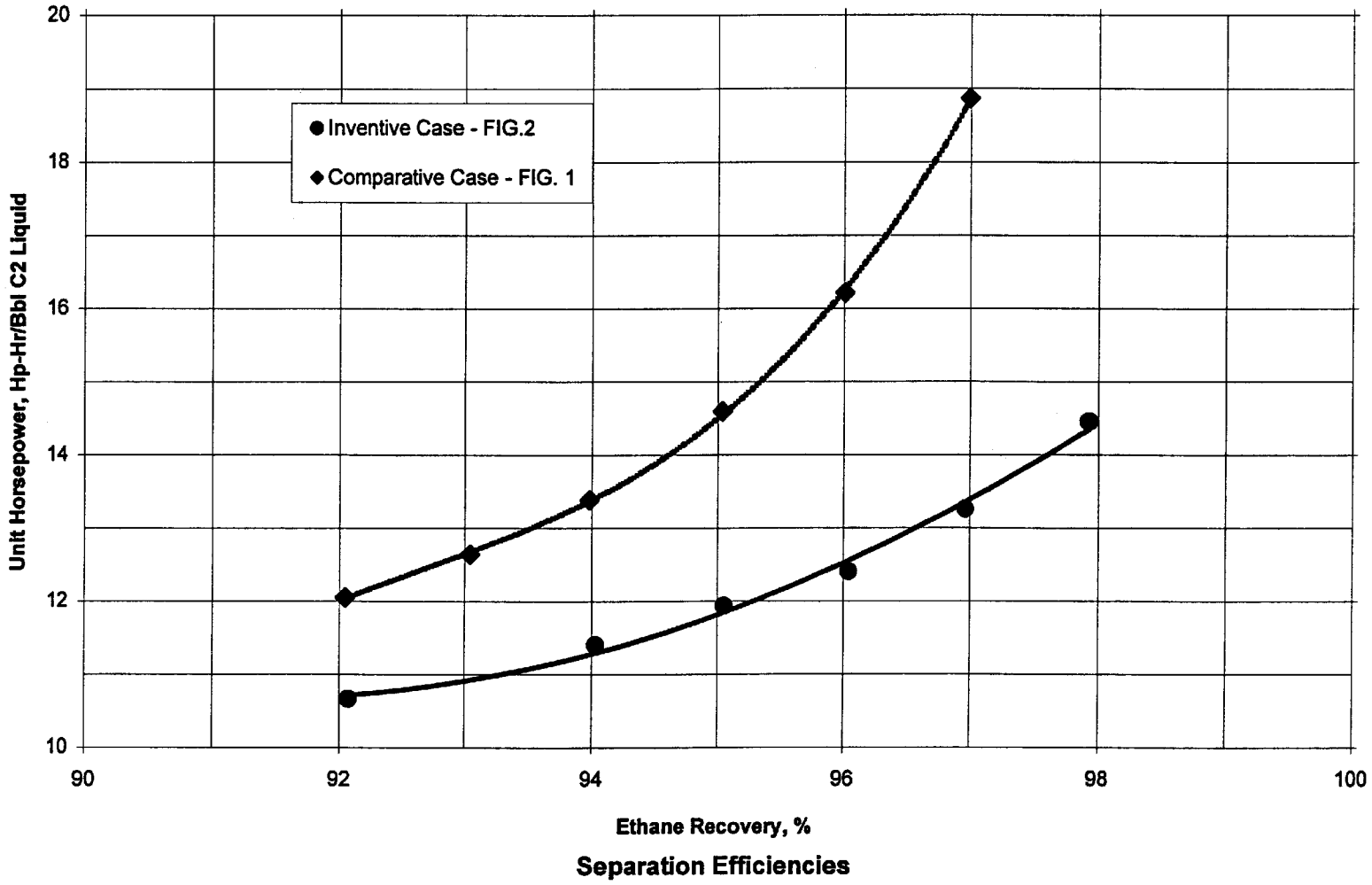
FIG. 5 is a graph of separation efficiencies of the comparative system with an embodiment of the inventive system.

In summary, the new idea provides a simple, efficient and cost effective process for recovering ethane and heavy components. It improves the separation efficiency over the comparative methods in a wide range of recovery level as demonstrated in the FIG. 5 graph.

Figure 6:
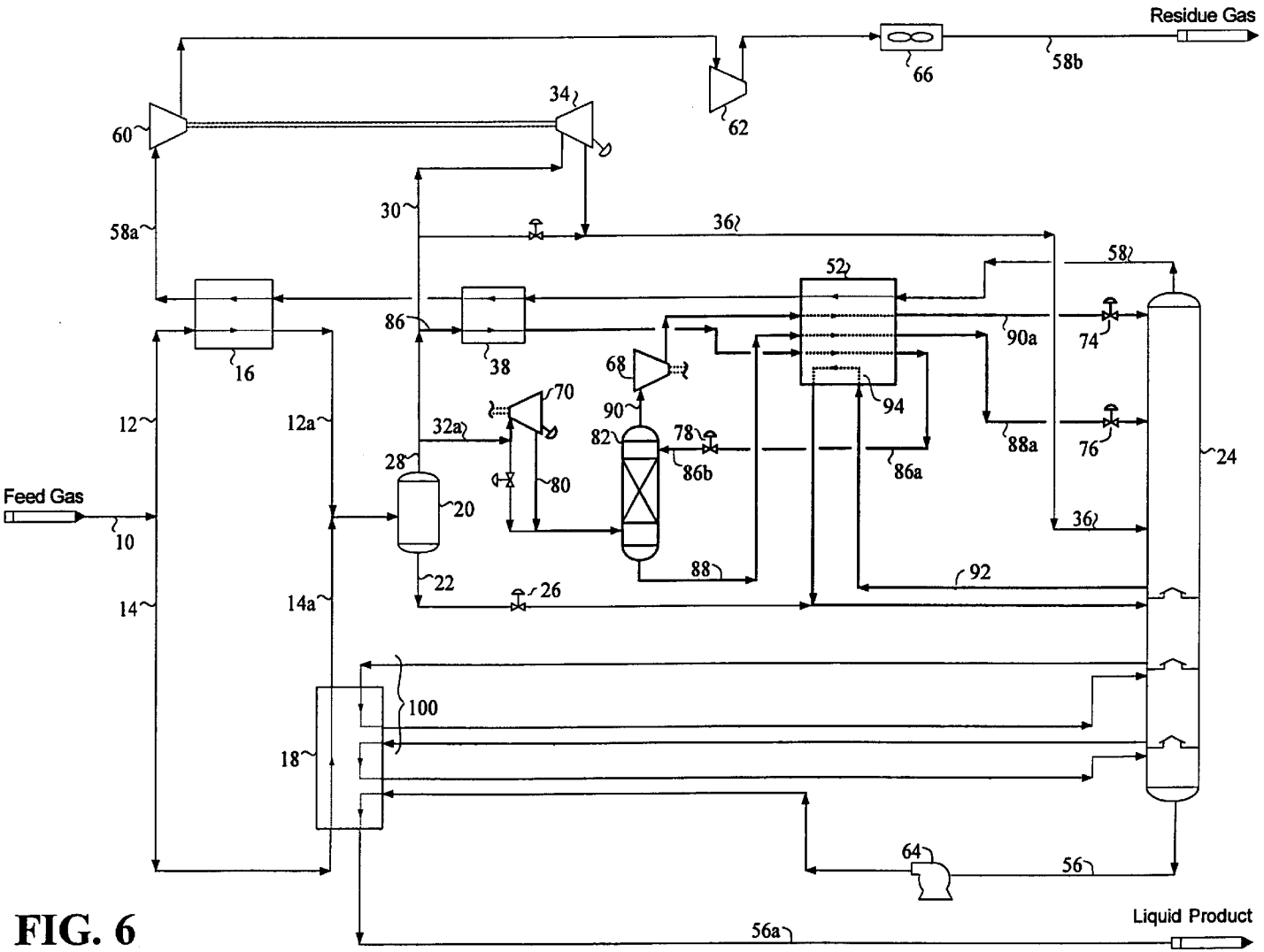
FIG. 6 is an alternate arrangement of a cryogenic expansion process incorporating the improvements of the present invention, wherein a small expander/compressor is provided in connection with the lean reflux absorber.

The recovery efficiency can be further improved by another embodiment of the present invention where a small expander/compressor is used. FIG. 6 represents a schematic embodiment illustrating such an improvement to further enhance the recovery efficiency. The system illustrated in FIG. 6 is essentially identical to that in FIG. 2 and operates in a similar manner accordingly, except for the differences detailed below. With reference to FIG. 6, the second vapor portion 32*a* of vapor stream 28 from expander inlet separator 20, instead of being cooled in precooler 38 and then expanded through the expansion valve 84 as in FIG. 2, passes directly through a work-expansion turbine 70. Within the work-expansion turbine 70, the vapor is expanded almost isotropically to a lower pressure of lean reflux absorber 82 at about 415 psia, in a non-limiting example, resulting in work extraction and cooling the expanded stream to form a partially condensed stream 80 at about −113° F. The partially condensed stream is then directed to the bottom of lean reflux absorber 82. The mechanical work generated through the vapor expansion can be used to compress the leaner vapor stream 90 leaving the overhead of lean reflux absorber 82. The compressed vapor stream 90*a* is delivered to the top of the demethanizer 24 via expansion valve 74, after being cooled to substantial condensation as previously described.

The use of a small expander/compressor 70 as depicted in the FIG. 6 embodiment allows the lean reflux absorber 82 to be operated at a lower pressure and a leaner top reflux stream to be generated more efficiently, thereby improving overall recovery efficiency. By operating the lean reflux absorber 82 at a lower pressure leads to following consequences and advantages, thereof:

The expansion ratio is increased with additional work generated by the expansion turbine, thereby more cold refrigeration is available for process cooling.

The relative volatility between the key light and heavy components, e.g. methane and ethane in this example, is increased, thereby enhancing the separation efficiency inside the cryogenic distillation column.

The overhead vapor stream 90 leaving the lean reflux absorber 82 becomes leaner (namely less) in ethane and heavier and advantageous to overall recovery of ethane within the demethanizer 24 because it is ultimately used as the top reflux stream.

The use of expansion work in compressing the vapor stream 90 raises the leaner vapor stream to a pressure suitable for subsequent cooling and condensation by the residue gas stream 58 from the demethanizer 24.

The enhancement in recovery efficiency becomes evident by comparing the performances of FIG. 2 and FIG. 6 processes in one example as reported in Table II where the same feed gas composition and conditions are applied to both process schemes with a targeted 98% ethane recovery. As demonstrated, a leaner top reflux stream with an ethane content of 0.99 mol % is created via the FIG. 6 arrangement as compared to 1.65 mol % from that of FIG. 2. This leaner top feed enables the demethanizer to operate at a higher pressure, yet maintaining the same 98% ethane recovery level. As a consequence, the re-compression horsepower is reduced and the recovery efficiency is improved by approximately 15% in this example.

TABLE II

Performance Comparison Between Inventive Processes

| Description | FIG. 2 | FIG. 6 |
|---|---|---|
| Demethanizer Pressure, psia | 352 | 370 |
| Liquid Recovery | | |
| Ethane Product, Bbl/Day | 21,279 | 21,297 |
| % Recovery - C2 | 97.93 | 98.01 |
| % Recovery - C3 | 99.91 | 99.96 |
| Compression, HP | 12,816 | 11,156 |
| Recovery Efficiency | | |
| HP-Hr/BbL of C2 Liq. | 14.45 | 12.57 |
| % Dev. | 15.0% | 0.0% |
| Demethanizer Top Reflux | | |
| Flow, lb-mol/hr | 9,910 | 9,210 |
| Ethane Content, mol % | 1.65 | 0.99 |
| Demethanizer Mid Reflux Temp. ° F.* | −146 | −143 |

*Temperature prior to expansion valve.

The improved process in accordance with FIG. 6 embodiment, however, requires one additional expander/compressor operated at cryogenic temperatures with the heat of compression introduced at cryogenic temperatures as well. In another arrangement of this improvement (not illustrated here), the lean vapor stream 90 can be warmed to near the ambient temperature at which less expensive material can be used. Additionally, the heat of compression can be rejected to the atmosphere or a warmer temperature.

Figure 7:
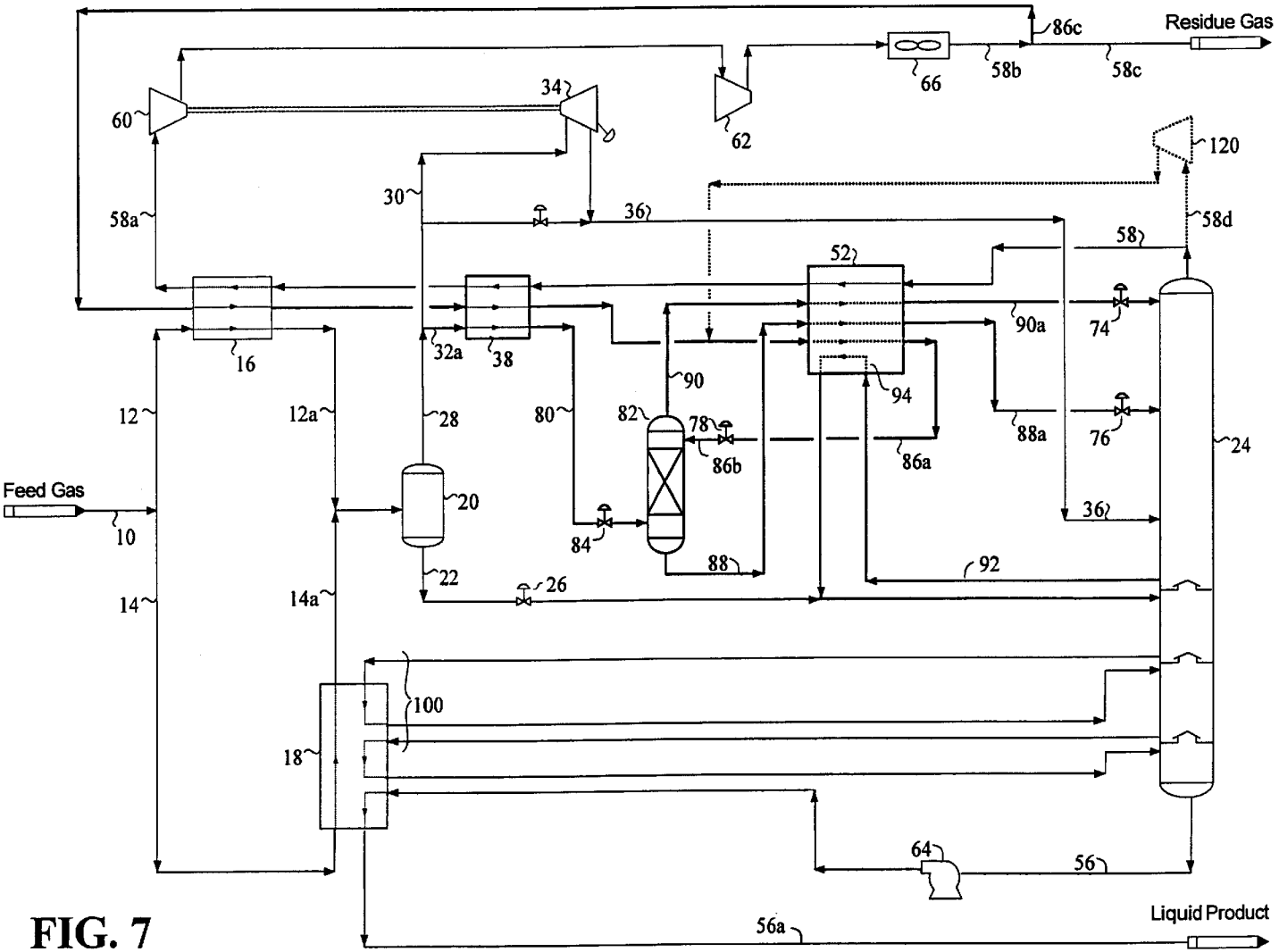
FIG. 7 is another alternate arrangement of a cryogenic expansion process incorporating the improvement of the present invention, wherein the top feed to the lean reflux absorber is derived from a small portion of volatile residue gas.

In yet another embodiment of the present invention as illustrated in FIG. 7, the recovery efficiency of FIG. 2 process can be also enhanced by recycling a portion of residue gas at elevated pressure into the inventive lean reflux absorber design. Again, the system illustrated in FIG. 7 is essentially the same as that in FIG. 2 and operates in a similar manner accordingly. The difference resides in where the top feed (reflux) to the lean reflux absorber 82 is taken from. Referring to FIG. 7, the cooled vapor portion 28 from separator 20 is divided into two portions 30 and 32*a*, which are expanded and directed to the demethanizer 24 and the lean reflux absorber 82 in the same manner as previously described in the inventive process shown in FIG. 2. Instead of using the vapor from separator 20, the top feed 86*b* for the lean reflux absorber 82 is taken from the residue gas 58*b* after final compression and cooling. This recycle stream 86*c*, a small portion of the compressed residue gas, is cooled to substantial condensation, e.g. through exchangers 16, 38, and 52, prior to being expanded to the top of lean reflux absorber 82 as reflux stream 86*b*.

The use of residue gas, containing the least amount of ethane, as the top reflux stream in one non-limiting embodiment, e.g. FIG. 7, enhances the separation efficiency within the absorption tower, e.g. lean reflux absorber 82, in this case. As a result, the volatile overhead stream leaves the tower leaner, i.e. contains less ethane, in this case. Likewise, the residue gas from the demethanizer 24 overhead contains less ethane and the overall recovery efficiency in this inventive scheme is improved.

The enhancement in recovery efficiency becomes evident by comparing the performances of FIG. 2 and FIG. 7 processes in one non-limiting example as reported in Table III, where the same feed gas composition and conditions are applied to both process schemes with a targeted 98% ethane recovery. As shown, a leaner top reflux stream with an ethane content of 0.83 mol % is created via the FIG. 7 arrangement as compared to 1.65 mol % from that of FIG.

2. This leaner top feed enables the demethanizer to operate at a higher pressure, yet maintaining the same 98% ethane recovery level. Consequently, the recompression horsepower is reduced and the recovery efficiency is improved by approximately 7.1% in this example.

TABLE III

Performance Comparison Between Inventive Processes

| Description | FIG. 2 | FIG. 7 |
|---|---|---|
| Demethanizer Pressure, psia | 352 | 372 |
| Liquid Recovery | | |
| Ethane Product, Bbl/Day | 21,279 | 21,292 |
| % Recovery - C2 | 97.93 | 97.99 |
| % Recovery - C3 | 99.91 | 99.99 |
| Compression, HP | 12,816 | 11,977 |
| Recovery Efficiency | | |
| HP-Hr/BbL of C2 Liq. | 14.45 | 13.50 |
| % Dev. | 7.1% | 0.0% |
| Demethanizer Top Reflux | | |
| Flow, lb-mol/hr | 9,910 | 8,560 |
| Ethane Content, mol % | 1.65 | 0.83 |
| Demethanizer Mid Reflux Temp. ° F.* | −146 | −143 |

*Temperature prior to expansion valve.

By comparing Tables II and III, it is revealed that the reflux created in the FIG. 7 embodiment is leaner, yet its recovery is less efficient than that of FIG. 6. The recycle stream requires compression to a pressure suitable for substantial condensation to provide the benefits of reflux rectification. Depending on how much leaner reflux the improved scheme produces, the benefits of having a leaner reflux may, in some cases, be offset by the additional compression power required for the recycle reflux scheme as illustrated here. It is also noted that the recycle reflux stream can be taken directly from the demethanizer 24 overhead as shown in dashed line 58*d* as an alternate configuration of FIG. 7 process and provides similar advantages to NGL (natural gas liquids) recovery in most cases. In this arrangement, one cryogenic compressor 120, which allows the recycle stream to be compressed to an optimal pressure for substantial condensation will normally be required. Similarly, in the case of using warm residue gas as a recycle reflux stream, various configurations can be arranged depending upon final deliver pressure of the residue gas product. For instance, one separate booster compressor for the recycle stream may be needed when the delivery pressure is too low. Alternatively, for the cases of high delivery pressure, the recycle stream may be taken at the intermediate pressure level during the final recompression step to conserve energy spent on the pressure boosting unnecessarily.

In the foregoing description, the application and principles of the invention have been directed to the illustrated embodiments in which the innovative lean reflux absorption is linked primarily to a partial vapor stream, normally 30–35%, from the expander inlet separator 20. Alternate configurations of the inventive system are expected to be useful. For instance, the lean reflux absorption can be connected to a partial stream of the feed gas in any cooling stage prior to the separator 20, including non-cooled dry feed gas stream. Additionally, the illustrated embodiments have been constructed specifically for a facility with a sufficient inlet pressure. In the case that the plant inlet pressure is low, the lean reflux absorption configured in another embodiment, e.g. FIG. 8, can be advantageous in most instances, particularly for converting an existing facility from ethane rejection operation to ethane recovery operation.

To enhance ethane and NGL recovery efficiency, there is always the need for cold and leaner reflux streams for the top rectification section of the demethanizer. In addition, there is the need for the turbo expander 34 to be operated with a high expansion ratio, typically in excess of 2.0, such that a significant amount of work recovered and refrigeration generated at cryogenic temperatures. To create a high expansion ratio across the expander 34 when the inlet pressure is not sufficient, it is normally taught in the prior art to either operate the demethanizer 24 at a even more reduced pressure or raise the feed gas pressure as needed. The former option leads to a higher recompression horsepower or a possibility of $CO_2$ freezing when the feed gas contains a considerable amount of $CO_2$. On the other hand, horsepower requirement for the front end boosting is also high for the latter case. In both cases, compression power has been applied to the total flow either at the front-end (i.e. feed gas) or the back-end (i.e. residue gas) to gain the expander refrigeration, which is not the most efficient approach in most cases.

Figure 8:
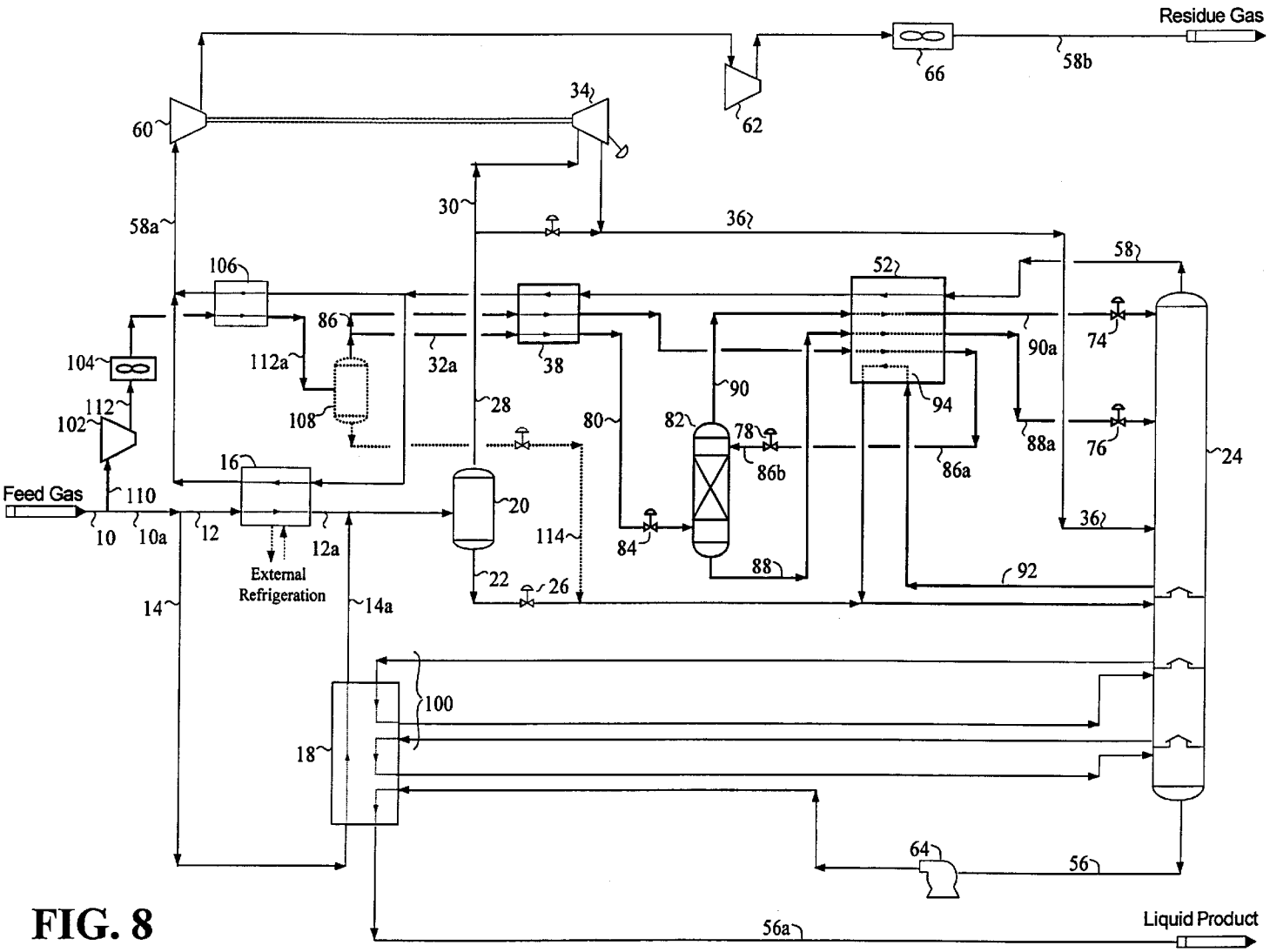
FIG. 8 is another alternate arrangement of a cryogenic expansion process incorporating the improvements of the present invention, wherein a smaller portion of feed gas is compressed to provide feeds for the lean reflux absorber in the case of a low inlet pressure.

Referring to FIG. 8, dry feed gas 10 enters the cryogenic process at an elevated pressure, preferably ranging from 400 to 750 psig, is first split into two portions. The main portion 10*a*, approximately 65–75%, is cooled via a heating/-cooling arrangement similar to FIG. 2 prior to entering the expander inlet separator 20 for the separation of condensed liquid, if any. There may also be a need for external refrigeration (e.g. propane) to assist condensation of heavier components if the feed gas is rich. The entire vapor portion 28 and liquid portion 22 are expanded to demethanizer via work expansion turbine 34 and expansion valve 26, respectively, as previously described. The remaining feed gas portion 110 is first boosted by compressor 102 to a pressure suitable for lean reflux absorption, typically higher than 500 psig, and resulting stream 112 is precooled through exchangers 104 and 106 to give stream 112*a*. The cold separator 108 shown in dashed line is normally not required unless the feed gas contains heavy components, e.g. aromatics, which may freeze up at even colder temperature downstream. The heavy components will be condensed after precooling and separated in the cold separator 108, if necessary. The heavy liquid portion 114 is admitted to the middle section of demethanizer 24, where it is warmer and the concern of heavy hydrocarbon freezing is therefore prevented. The inclusion of cold separator 108 would also be appropriate when a small expander/compressor is employed in the lean reflux absorption embodiment similar to that shown in FIG. 6. This is because any liquid droplets need to be removed prior to the admittance to the expander 70. The cooled stream is divided into two portions 86 and 32*a*. One portion 32*a* is directed to the bottom of lean reflux absorber 82 with or without further cooling through exchanger 38. The other portion 86 is delivered to the top of lean reflux absorber 82 after being cooled to substantial condensation (e.g. through exchangers 38 and 52).

Figure 9:
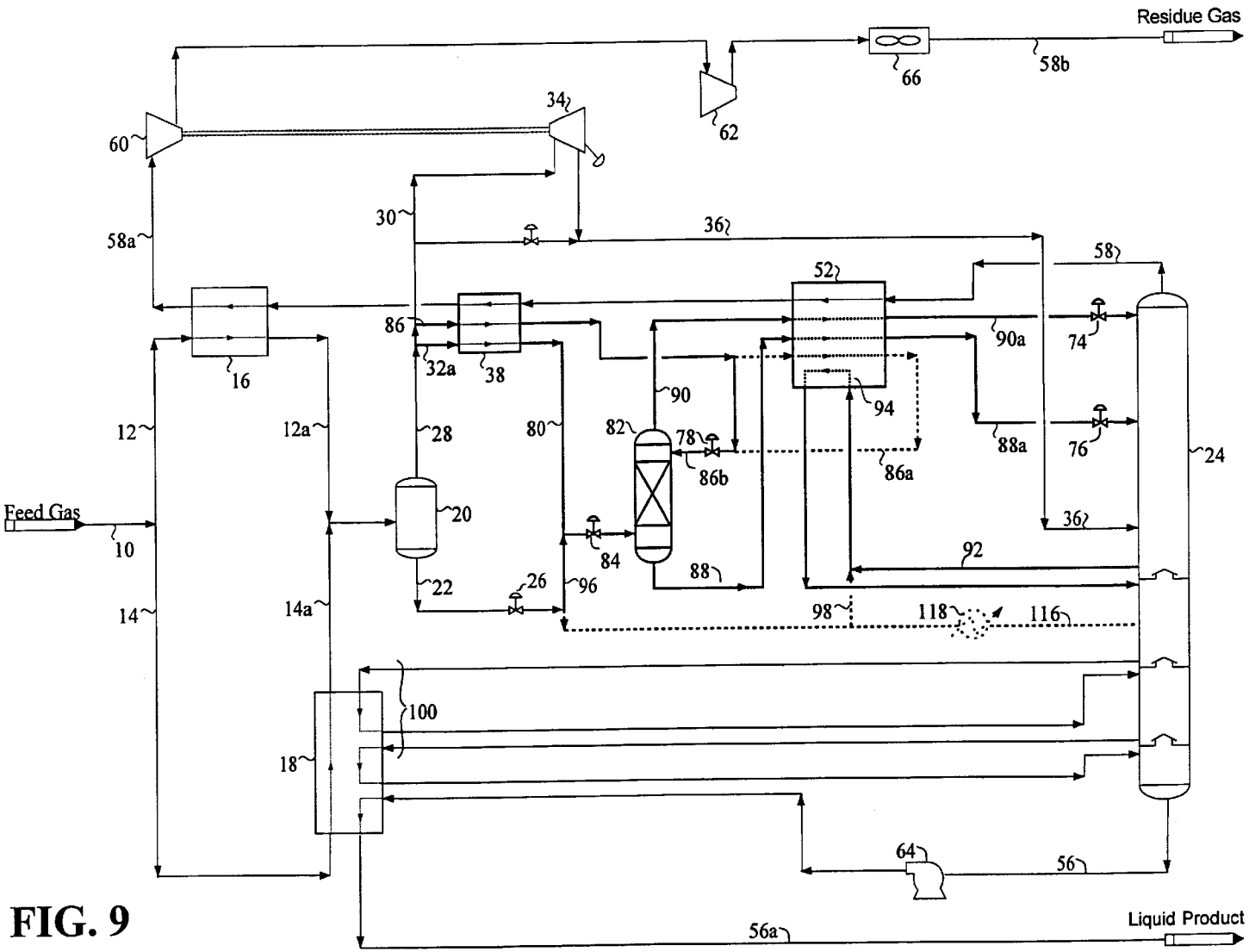
FIG. 9 is another alternate arrangement of a cryogenic expansion process incorporating the improvements of the present invention.

Shown in FIG. 9 is another alternate arrangement of a cryogenic expansion process incorporating the improvement of the present idea. Depending on the feed gas composition and desired recovery level, it may be advantageous to route part of entire liquid stream 22 from the expander feed separator 20 either to the lean reflux absorber 82 via stream 96 to be used as reflux, or to the cold side reboiler 94 via stream 98 as a refrigerant aid to preferentially boil off lighter components, or directly to the cryogenic distillation column 24 as a middle feed 116 after first being optionally preheated by heat exchanger 118. From the top of the cryogenic distillation column 24 down, the feeds can be understood as top feed 90*a* (leaner vapor stream from lean reflux absorber 82 overhead), first middle feed 88*a* (bottom fluid stream from lean reflux absorber 82, in most cases a liquid stream), second middle feed 36 (expander 34 discharge), and third middle feed 22/116 (condensed liquid stream from separator 20). Furthermore, the expander inlet separator 20 can sometimes be eliminated in cases, e.g. lean feed gas, where no liquid condensation occurs during feed gas cooling.

In the foregoing specification, the invention has been described with reference to specific embodiments thereof, and has been demonstrated as effective in providing structures and processes for maximizing the recovery of ethane and heavier components from a stream containing those components and methane. However, it will be evident that various modifications and changes can be made thereto without departing from the broader spirit or scope of the invention as set forth in the appended claims. Accordingly, the specification is to be regarded in an illustrative rather than a restrictive sense. For example, there may be other ways of configuring and/or operating the hydrocarbon gas processing system of the invention differently from those explicitly described herein which nevertheless fall within the scope of the claims. It is anticipated that by routing certain streams differently, or by adjusting operating parameters certain optimizations and efficiencies may be obtained which would nevertheless not cause the system to fall outside of the scope of the appended claims.

We claim:

1. A process for recovering components of a hydrocarbon-containing feed gas via a cryogenic distillation column wherein its reflux components are cryogenically generated by a separate lean reflux absorber, comprising:

a) deriving a top feed portion and a bottom feed portion to said lean reflux absorber by dividing a feed gas stream into a top feed portion, a bottom feed portion, and a first gas portion, and thereafter cooling and separating said first gas portion into a first liquid phase comprising condensed components and a main vapor portion;

b) condensing said top feed portion and thereafter introducing it to the top of said lean reflux absorber comprising one or more mass transfer stages;

c) introducing said bottom feed portion to said lean reflux absorber at a location below said condensed top feed portion;

d) rectifying within said lean reflux absorber to produce a lean vapor phase from an upper region of said lean reflux absorber, and a bottom fluid stream comprising the remaining components from the bottom of said lean reflux absorber;

e) condensing said lean vapor phase to form a lean reflux stream for top feed to said cryogenic distillation column;

f) expanding and lowering the pressure of:

(i) said lean reflux stream and supplying it as reflux to the top of said cryogenic distillation column, (ii) said bottom fluid stream and supplying it as a first middle feed to a middle region of said cryogenic distillation column at a point below top reflux, (iii) said main vapor portion and supplying it as a second middle feed to the middle region of said cryogenic distillation column at a point below the top reflux and at least the same as or above the first liquid phase, if present, and (iv) said first liquid phase, if present, and supplying it as a third middle feed to the middle region of said cryogenic distillation column at a point not higher than the second middle feed, and g) recovering natural gas liquid product from the bottom of said cryogenic distillation column.

2. The process of claim 1 where a) deriving a top feed portion and a bottom feed portion is conducted by approach (iii) and further comprising separating said cooled first gas portion into a first liquid phase comprising condensed components and a main vapor portion.

3. The process of claim 2 further comprising introducing at least a portion of said first liquid phase to a lower region of said lean reflux absorber.

4. The process of claim 1 further comprising expanding said bottom feed portion through an expander thereby further cooling the stream prior to introducing it to said lean reflux absorber at a point below said condensed top feed portion.

5. A process for recovering components of a hydrocarbon-containing feed gas via a cryogenic distillation column wherein its reflux components are cryogenically generated by a separate lean reflux absorber, comprising:

a) deriving a top feed portion and a bottom feed portion to said lean reflux absorber by an approach selected from the group consisting of:

(i) cooling and thereafter separating a feed gas stream into a first liquid phase comprising condensed components, and a cooled vapor phase and thereafter dividing said cooled vapor phase into a top feed portion, a bottom feed portion, and a main vapor portion;

(ii) cooling and thereafter dividing a feed gas stream into a top feed portion, a bottom feed portion, and a main vapor portion in the absence of liquid condensation during the cooling step;

(iii) dividing a feed gas stream into a top feed portion, a bottom feed portion, and a first gas portion, and thereafter cooling said first gas portion to provide a main vapor portion; and b) condensing said top feed portion and thereafter introducing it to the top of said lean reflux absorber comprising one or more mass transfer stages;

c) introducing said bottom feed portion to said lean reflux absorber at a location below said condensed top feed portion;

d) rectifying within said lean reflux absorber to produce a lean vapor phase from an upper region of said lean reflux absorber, and a bottom fluid stream comprising the remaining components from the bottom of said lean reflux absorber;

e) compressing said lean vapor phase from an upper region of said lean reflux absorber to a higher pressure;

f) condensing said compressed lean vapor phase to form a lean reflux stream as top feed to the cryogenic distillation column;

g) expanding and lowering the pressure of:

(i) said lean reflux stream and supplying it as reflux to the top of said cryogenic distillation column, (ii) said bottom fluid stream and supplying it as a first middle feed to a middle region of said cryogenic distillation column at a point below top reflux, (iii) said main vapor portion and supplying it as a second middle feed to the middle region of said cryogenic distillation column at a point below the top reflux and at least the same as or above the first liquid phase, if present, and (iv) said first liquid phase, if present, and supplying it as a third middle feed to the middle region of said cryogenic distillation column at a point not higher than the second middle feed, and h) recovering natural gas liquid product from the bottom of said cryogenic distillation column.

6. The process of claim 5 wherein said lean vapor phase is warmed prior to being compressed to a higher pressure.

7. The process of claim 5 further comprising expanding said bottom feed portion through an expander thereby further cooling the stream prior to introducing it to said lean reflux absorber at a point below said condensed top feed portion and recovering expansion work from the expander and wherein said expansion work recovered is used to compress said lean vapor phase.

8. The process of claim 1 wherein said bottom fluid stream is further cooled prior to being expanded to said cryogenic distillation column to reduce vapor flashing upon expansion.

9. A process for recovering components of a hydrocarbon-containing feed gas via a cryogenic distillation column wherein its reflux components are cryogenically generated by a separate lean reflux absorber, comprising:

a) deriving a top feed portion and a bottom feed portion to said lean reflux absorber by an approach selected from the group consisting of:
   (i) cooling and thereafter separating a feed gas stream into a first liquid phase comprising condensed components, and a cooled vapor phase and thereafter dividing said cooled vapor phase into a top feed portion, a bottom feed portion, and a main vapor portion;
   (ii) cooling and thereafter dividing a feed gas stream into a top feed portion, a bottom feed portion, and a main vapor portion in the absence of liquid condensation during the cooling step;
   (iii) dividing a feed gas stream into a top feed portion, a bottom feed portion, and a first gas portion, and thereafter cooling said first gas portion to provide a main vapor portion; and b) condensing said top feed portion and thereafter introducing it to the top of said lean reflux absorber comprising one or more mass transfer stages;

c) introducing said bottom feed portion to said lean reflux absorber at a location below said condensed top feed portion;

d) rectifying within said lean reflux absorber to produce a lean vapor phase from an upper region of said lean reflux absorber, and a bottom fluid stream comprising the remaining components from the bottom of said lean reflux absorber;

e) condensing said lean vapor phase to form a lean reflux stream for top feed to said cryogenic distillation column;

f) expanding and lowering the pressure of:
   (i) said lean reflux stream and supplying it as reflux to the top of said cryogenic distillation column,
   (ii) said bottom fluid stream and supplying it as a first middle feed to a middle region of said cryogenic distillation column at a point below top reflux,
   (iii) said main vapor portion and supplying it as a second middle feed to the middle region of said cryogenic distillation column at a point below the top reflux and at least the same as or above the first liquid phase, if present, and
   (iv) said first liquid phase, if present, and supplying it as a third middle feed to the middle region of said cryogenic distillation column at a point not higher than the second middle feed, and g) withdrawing at least a portion of liquid from said cryogenic distillation column at a point near the feed of the expander discharge;

h) heating said withdrawn liquid to provide cooling to a stream selected from the group consisting of said lean vapor phase, said top feed portion, said bottom fluid stream, or a combination thereof, and i) returning said heated withdrawn liquid to said cryogenic distillation column at a point below where it was withdrawn; and j) recovering natural gas liquid product from the bottom of said cryogenic distillation column.

10. The process of claim 1 further comprising introducing at least a portion of said first liquid phase, if present, to said lean reflux absorber.

11. A process for recovering components of a hydrocarbon-containing feed gas via a cryogenic distillation column wherein its reflux components are cryogenically generated by a separate lean reflux absorber, comprising:

a) dividing a feed gas into a first gas fraction, and a second gas fraction;

b) compressing said second gas fraction to a pressure higher than that of said cryogenic distillation column to form a compressed gas stream;

c) cooling said compressed gas stream and thereafter dividing it into a bottom feed portion and a top feed portion;

d) further condensing said top feed portion and thereafter introducing it to the top of said lean reflux absorber comprising one or more mass transfer stages;

e) introducing said bottom feed portion to said lean reflux absorber at a location below said condensed top feed portion;

f) rectifying within said lean reflux absorber to produce a lean vapor phase from an upper region of said lean reflux absorber, and a bottom fluid stream from the bottom of said lean reflux absorber;

g) deriving a main vapor portion by an approach selected from the group consisting of:
   (i) cooling said first gas fraction to partial condensation and thereafter separating it into a first liquid phase comprising condensed components, and a main vapor portion comprising predominantly volatile vapor components, and
   (ii) cooling said first gas portion to provide a main vapor portion in the absence of liquid condensation during the cooling step;

h) condensing said lean vapor phase to provide a liquid reflux stream as top feed to the cryogenic distillation column;

i) expanding and lowering the pressure of:
   (i) said lean reflux stream and supplying it as reflux to the top of said cryogenic distillation column,
   (ii) said bottom fluid stream and supplying it as a first middle feed to a middle region of said cryogenic distillation column at a point below top reflux,
   (iii) said main vapor portion and supplying it as a second middle feed to the middle region of said cryogenic distillation column at a point below the top reflux and at least the same as or above the first liquid phase, if present,
   (iv) said first liquid phase, if present, and supplying it as a third middle feed to the middle region of said cryogenic distillation column at a point not higher than the second middle feed, and;

j) recovering natural gas liquid product from the bottom of said cryogenic distillation column.

12. The process of claim 11, wherein step c) comprises:

(i) at least partially condensing said compressed gas stream to form a two-phase stream;

(ii) separating said two-phase stream into a cooled vapor stream, and into a cooled liquid stream;

(iii) dividing said cooled vapor stream into a top feed portion, and a bottom feed portion; and (iv) expanding and lowering the pressure of said cooled liquid stream and supplying it as a third middle feed to the middle region of said cryogenic distillation column at a point not higher than the second middle feed.

13. The process of claim 12 further comprising introducing at least a portion of said cooled liquid stream to a lower region of said lean reflux absorber.

14. The process of claim 11 further comprising expanding said main vapor portion through an expander thereby providing further cooling prior to supplying it to said cryogenic distillation column.

15. The process of claim 11 further comprising expanding said bottom feed portion through an expander thereby further cooling the stream prior to introducing it to said lean reflux absorber at a point below said condensed top feed portion.

16. The process of claim 11 further comprising compressing said lean vapor phase from an upper region of said lean reflux absorber to a higher pressure prior to substantial condensation to provide a liquid reflux as top feed to the cryogenic distillation column.

17. The process of claim 16, wherein said lean vapor phase is warmed prior to being compressed to a higher pressure.

18. The process of claim 15 further comprising recovering expansion work from the expander and wherein said expansion work recovered is used to compress said lean vapor phase.

19. The process of claim 11 further comprising cooling said bottom feed portion prior to introducing it to said lean reflux absorber.

20. The process of claim 11 wherein said bottom fluid stream is further cooled prior to being expanded to said cryogenic distillation column to reduce vapor flashing upon expansion.

21. The process of claim 11 further comprising:

a) withdrawing at least a portion of liquid from said cryogenic distillation column at a point near the feed of the expander discharge;

b) heating said withdrawn liquid to provide cooling to a stream selected from the group consisting of said lean vapor phase, said top feed portion, said bottom fluid stream, or a combination thereof; and c) returning said heated withdrawn liquid to said cryogenic distillation column at a point below where it was withdrawn.

22. The process of claim 11 further comprising introducing at least a portion of said first liquid phase to said lean reflux absorber.

23. A process for recovering components of a hydrocarbon-containing feed gas via a cryogenic distillation column wherein its reflux components are cryogenically generated by a separate lean reflux absorber, comprising:

a) deriving a bottom feed portion to said lean reflux absorber by an approach selected from the group consisting of:

(i) cooling said feed gas and thereafter separating it into a first liquid phase comprising condensed components, and a first vapor phase comprising predominantly volatile vapor components; then dividing said first vapor phase into a main vapor portion, and a bottom feed portion;

(ii) dividing said feed gas into a first gas fraction and a second gas fraction and thereafter cooling said first gas fraction to form a bottom feed portion; cooling said second gas fraction and separating it into a first liquid phase and a main vapor portion;

(iii) dividing said feed gas into a first gas fraction and a second gas fraction and thereafter compressing and cooling said first gas fraction to form a bottom feed portion; cooling said second gas fraction and separating it into a first liquid phase and a main vapor portion; and b) introducing said bottom feed portion to a lower region of said lean reflux absorber comprising one or more mass transfer stages;

c) removing a bottom fluid stream from the bottom of said lean reflux absorber;

d) expanding and lowering the pressure of:

(i) said bottom fluid stream and supplying it as a first middle feed to a middle region of said cryogenic distillation column at a point below top reflux, (ii) said main vapor portion and supplying it as a second middle feed to the middle region of said cryogenic distillation column at a point below the first middle feed, (iii) said first liquid phase and supplying it as a third middle feed to the middle region of said cryogenic distillation column at a point not higher than the second middle feed, e) removing cold residue gas from an upper region of said cryogenic distillation column;

f) drawing off a portion of said cold residue gas and compressing it to form a recycle residue gas;

g) condensing said recycle residue gas and thereafter introducing it to the top of said lean reflux absorber;

h) generating within said lean reflux absorber a lean vapor phase from an upper region thereof;

i) condensing said lean vapor phase to provide a liquid reflux and thereafter expanding and supplying it as reflux to the top of said cryogenic distillation column; and j) recovering natural gas liquid product from the bottom of said cryogenic distillation column.

24. The process of claim 23, wherein step f) comprises:

a) warming said cold residue gas to raise its temperature near ambient; and b) compressing said warm residue gas to a higher pressure and drawing off a portion of said compressed residue gas as the recycle residue gas.

25. In an apparatus for recovering components of a hydrocarbon-containing feed gas via a cryogenic distillation column to produce a natural gas liquid product, the apparatus comprising:

a) means for cooling and dividing said feed gas into a top feed portion, a bottom feed portion, and a main vapor portion;

b) means for condensing said top feed portion;

c) means for separation comprising one or more mass transfer stages, which receives said condensed top feed portion in a top region thereof, and said bottom feed portion in a lower region thereof; wherein said means for separation produces a lean vapor phase essentially free of components to be recovered in said natural gas liquid product from the top region thereof, and a bottom fluid stream from the bottom region thereof;

d) means for condensing said lean vapor phase to form a lean reflux stream, which means may be the same or different as means for condensing b);

e) a cryogenic distillation column having a plurality of feed points and recovery stages, which receives the main vapor portion and the following reflux streams to enhance recovery efficiency: (i) said lean reflux stream in the top of said cryogenic distillation column as a top reflux, and (ii) said bottom fluid stream in a middle region of said cryogenic distillation column as a middle reflux.

26. In an apparatus for recovering components of a hydrocarbon-containing feed gas via a cryogenic distillation column to produce a natural gas liquid product, the apparatus comprising:

a) means for cooling and dividing said feed gas into a top feed portion, a bottom feed portion, and a main vapor portion;

b) means for condensing said top feed portion;

c) means for separation comprising one or more mass transfer stages, which receives said condensed top feed portion in a top region thereof, and said bottom feed portion in a lower region thereof; wherein said means for separation produces a lean vapor phase essentially free of components to be recovered in said natural gas liquid product from the top region thereof, and a bottom fluid stream from the bottom region thereof;

d) a compressor for increasing the pressure of said lean vapor phase;

e) means for condensing said compressed lean vapor phase to form a lean reflux stream, which means may be the same or different as means for condensing b);

f) a cryogenic distillation column having a plurality of feed points and recovery stages, which receives the main vapor portion and the following reflux streams to enhance recovery efficiency:

(i) said lean reflux stream in the top of said cryogenic distillation column as a top reflux, and (ii) said bottom fluid stream in a middle region of said cryogenic distillation column as a middle reflux.

27. The apparatus of claim 26 further comprising a work expansion turbine for expanding said bottom feed portion and thereafter introducing the expanded steam to the lower portion of said separation means.

28. In an apparatus for recovering components of a hydrocarbon-containing feed gas via a cryogenic distillation column to produce a natural gas liquid product, the apparatus comprising:

a) means for splitting the feed gas into a first portion of said feed gas and a remaining portion of said feed gas;

b) a compressor for increasing the pressure of the first portion of said feed gas;

c) means for cooling and dividing said compressed feed gas into a top feed portion, and a bottom feed portion;

d) means for cooling the remaining portion of said feed gas to produce a main vapor portion;

e) means for condensing said top feed portion;

f) means for separation comprising one or more mass transfer stages, which receives said condensed top feed portion in a top region thereof, and said bottom feed portion in a lower region thereof; wherein said means for separation produces a lean vapor phase essentially free of components to be recovered in said natural gas liquid product from the top region thereof, and a bottom fluid stream from the bottom region thereof;

g) means for condensing said lean vapor phase to form a lean reflux stream, which means may be the same or different as means for condensing e);

h) a cryogenic distillation column having plurality of feed points and recovery stages, which receives the main vapor portion and the following reflux streams to enhance recovery efficiency:

(i) said lean reflux stream in the top of said cryogenic distillation column as a top reflux, and (ii) said bottom fluid stream in a middle region of said cryogenic distillation column as a middle reflux at a point below said top reflux.

29. In an apparatus for recovering components of a hydrocarbon-containing feed gas via a cryogenic distillation column to produce a natural gas liquid product, the apparatus comprising:

a) a compressor for increasing the pressure of a recycle residue gas from the top of said cryogenic distillation column;

b) means for cooling said compressed recycle residue gas to substantial condensation to provide a top feed portion;

c) means for cooling and dividing said feed gas into a main vapor portion, and a bottom feed portion;

d) means for separation comprising one or more mass transfer stages, which receives said condensed top feed portion in a top region thereof, and said bottom feed portion in a lower region thereof; wherein said means for separation produces a lean vapor phase essentially free of components to be recovered in said natural gas liquid product from the top region thereof, and a bottom fluid stream from the bottom region thereof;

e) means for condensing said lean vapor phase to form a lean reflux stream;

f) a cryogenic distillation column having plurality of feed points and recovery stages, which receives said main vapor portion and the following reflux streams to enhance recovery efficiency:

(i) said lean reflux stream in the top of said cryogenic distillation column as a top reflux, and (ii) said bottom fluid stream in the middle region of said cryogenic distillation column as a middle reflux.

30. The apparatus of claim 29 further comprising a booster compressor for increasing the pressure of at least a portion of said feed gas in the means of providing said bottom feed portion for said separation means.

31. The process of claim 2 wherein said bottom fluid stream is further cooled prior to being expanded to said cryogenic distillation column to reduce vapor flashing upon expansion.

32. The process of claim 5 wherein said bottom fluid stream is further cooled prior to being expanded to said cryogenic distillation column to reduce vapor flashing upon expansion.

33. The process of claim 5 further comprising introducing at least a portion of said first liquid phase, if present, to said lean reflux absorber.

34. The process of claim 9 further comprising introducing at least a portion of said first liquid phase, if present, to said lean reflux absorber.

* * * * *